US005692648A

United States Patent [19]

Su

[11] Patent Number: 5,692,648

[45] Date of Patent: *Dec. 2, 1997

[54] SEALING CAP OF AN ATOMIZER

[76] Inventor: Cheng-Yuan Su, P.O. Box 438, Hsinchu City, Taiwan

[ * ] Notice: The term of this patent shall not extend beyond the expiration date of Pat. No. 5,562,234.

[21] Appl. No.: 559,067

[22] Filed: Nov. 16, 1995

[51] Int. Cl.[6] ..... B67D 5/42

[52] U.S. Cl. ..... 222/321.2; 222/321.9

[58] Field of Search ..... 222/321.2, 321.3, 222/321.7, 321.9, 383.1, 382

[56] References Cited

U.S. PATENT DOCUMENTS

| | | | |
|---|---|---|---|
| 4,025,046 | 5/1977 | Boris . | |
| 4,155,489 | 5/1979 | Steiman | 222/321.9 |
| 4,277,001 | 7/1981 | Nozawa . | |
| 4,305,530 | 12/1981 | Nozawa . | |
| 4,369,900 | 1/1983 | Saito et al. . | |
| 4,462,549 | 7/1984 | Saito et al. . | |
| 4,606,479 | 8/1986 | Van Brocklin . | |
| 4,821,928 | 4/1989 | Su . | |
| 4,930,999 | 6/1990 | Brunet et al. . | |
| 5,370,280 | 12/1994 | Su . | |
| 5,562,234 | 10/1996 | Su | 222/321.9 |

FOREIGN PATENT DOCUMENTS

| | | |
|---|---|---|
| 2 314 772 | 1/1977 | France . |
| 2 512 517 | 3/1983 | France . |
| 2 004 585 | 4/1979 | United Kingdom . |

*Primary Examiner*—Philippe Derakshani
*Attorney, Agent, or Firm*—Bacon & Thomas

[57] ABSTRACT

A sealing cap including a metal cap shell and a sealing rubber fitted into the metal cap shell and mounted around the downward plunger of the press head of an atomizer, wherein the metal cap shell includes a flat annular base having an inner diameter and an outer diameter, a downward flange extending downwardly from the outer diameter of the flat annular base of the metal cap shell, a barrel raised from an inner diameter of the flat annular base of the metal cap shell and having an inward flange around a top opening thereof. The sealing rubber comprises a flat annular base fitted into the downward flange of the metal cap shell and attached to the flat annular base of the metal cap shell on the inside, a hollow cylindrical head raised from the flat annular base of the sealing rubber and fitted into the barrel of the metal cover shell, an annular coupling portion inwardly extending from the connecting area between the flat annular base and hollow cylindrical head of the sealing rubber, and a downward annular flange at the center of the topmost edge of the hollow cylindrical head for tightly engaging periphery of the bottom plunger of the atomizer press head.

1 Claim, 4 Drawing Sheets

SEALING CAP OF AN ATOMIZER

BACKGROUND OF THE INVENTION

The present invention relates to atomizers, and relates more particularly to a sealing cap covered on the neck of the container of an atomizer to prevent a leakage.

Various atomizers have been developed and used for different purposes, for example, for spraying paint, insecticide, perfume, etc. FIG. 1 shows a conventional atomizer which is comprised of a container H which holds a liquid, a metal covering D covered on the neck of the container H, a cap B and a gasket C fastened to the metal covering D, a press head 1 having a bottom plunger A inserted through the cap B and the gasket C, a cylinder E connected to the cap B and suspended inside the container H, a dip tube J connected to the bottom end of the cylinder E for inducing liquid from the container H into the cylinder E, a piston F connected to the plunger A of the press head 1 and moved by it in the accumulation chamber defined within the cylinder E, and a compression spring G mounted inside the cylinder E to give an upward force to the piston F. Referring to FIG. 2, when the press head 1 is depressed, the piston A is moved downwardly to force the liquid from the cylinder E out of the press head 1. When the press head 1 is released, liquid is induced from the container H into the cylinder E through the dip tube J. This structure of atomizer is still not satisfactory in function. When the press head 1 is depressed, liquid tends to be forced out of the cap B through the gap K between the cap B and the plunger A. When a leakage occurs, liquid cannot be efficiently forced out of the nozzle of the press head 1. Furthermore, because the cap B and the cylinder E are respectively molded from rigid plastic, it is difficult to force the cylinder E into engagement with the cap B.

SUMMARY OF THE INVENTION

The present invention provides a sealing cap for atomizers which eliminates the aforesaid drawbacks. It is therefore one object of the present invention to provide a sealing cap which effectively seals the atomizer. It is another object of the present invention to provide a sealing cap which can be conveniently installed.

DETAILED DESCRIPTION OF THE PREFERRED EMBODIMENT

Figure 1:
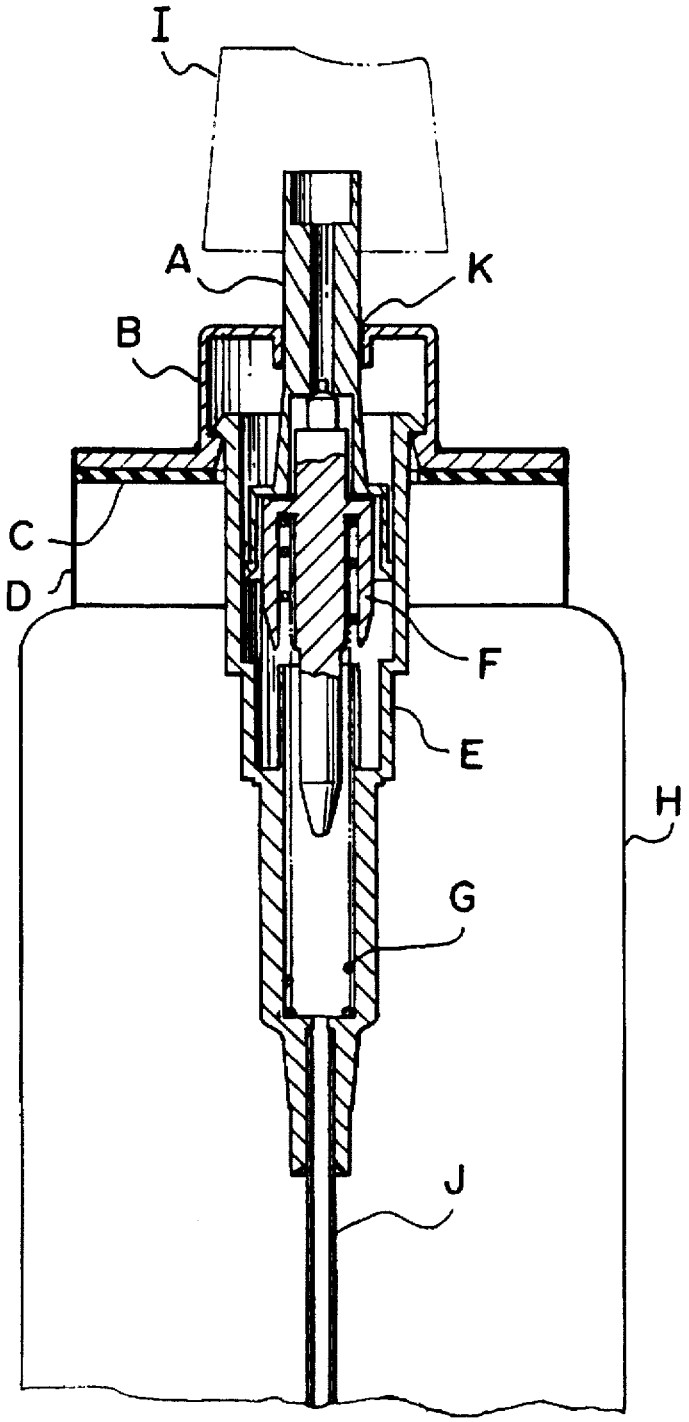
FIG. 1 is a sectional view of an atomizer according to the prior art.
Figure 2:
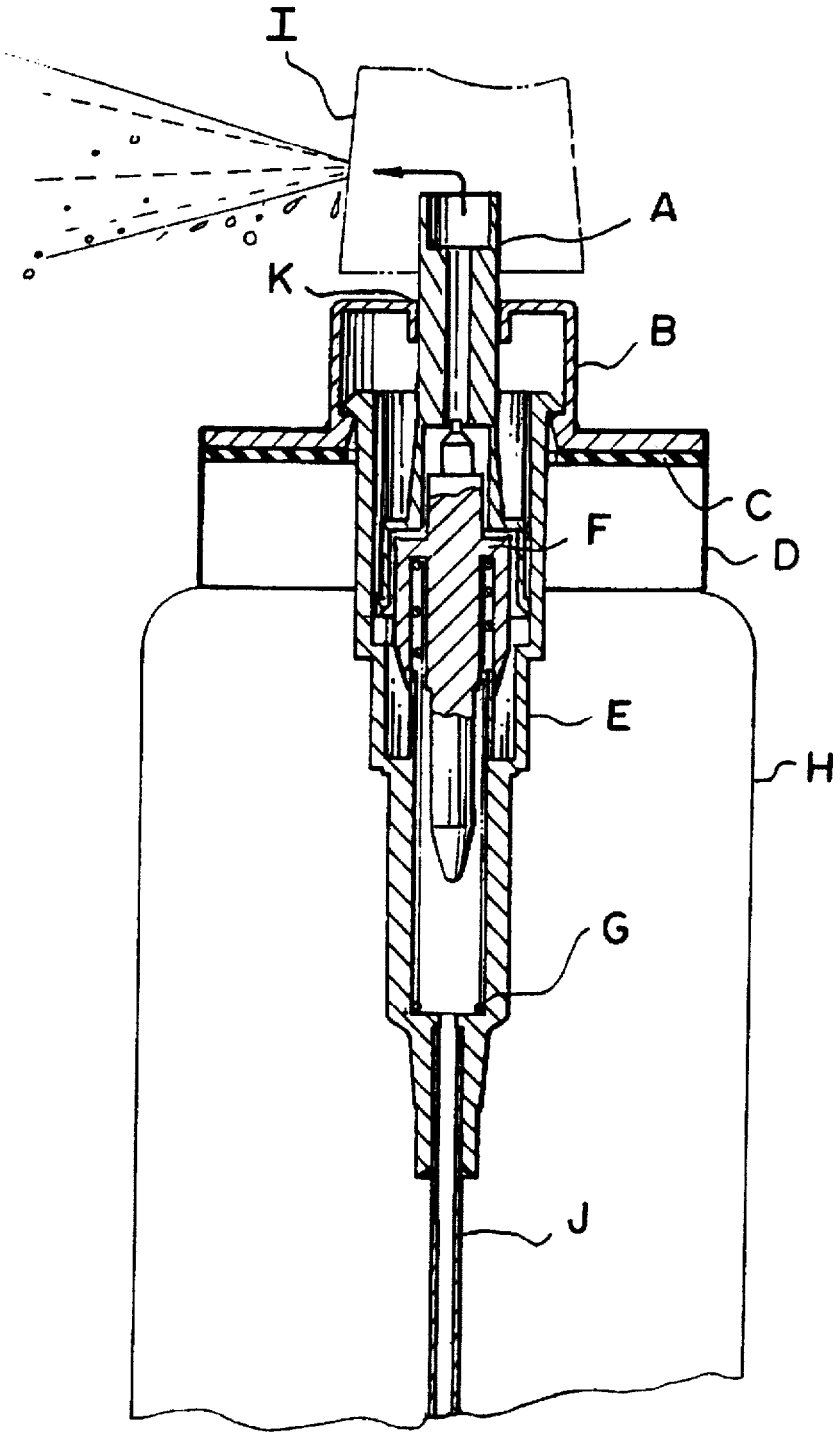
FIG. 2 is similar to FIG. 1 but showing the press head depressed, and fine drops of liquid ejected out of the press head.
Figure 3:
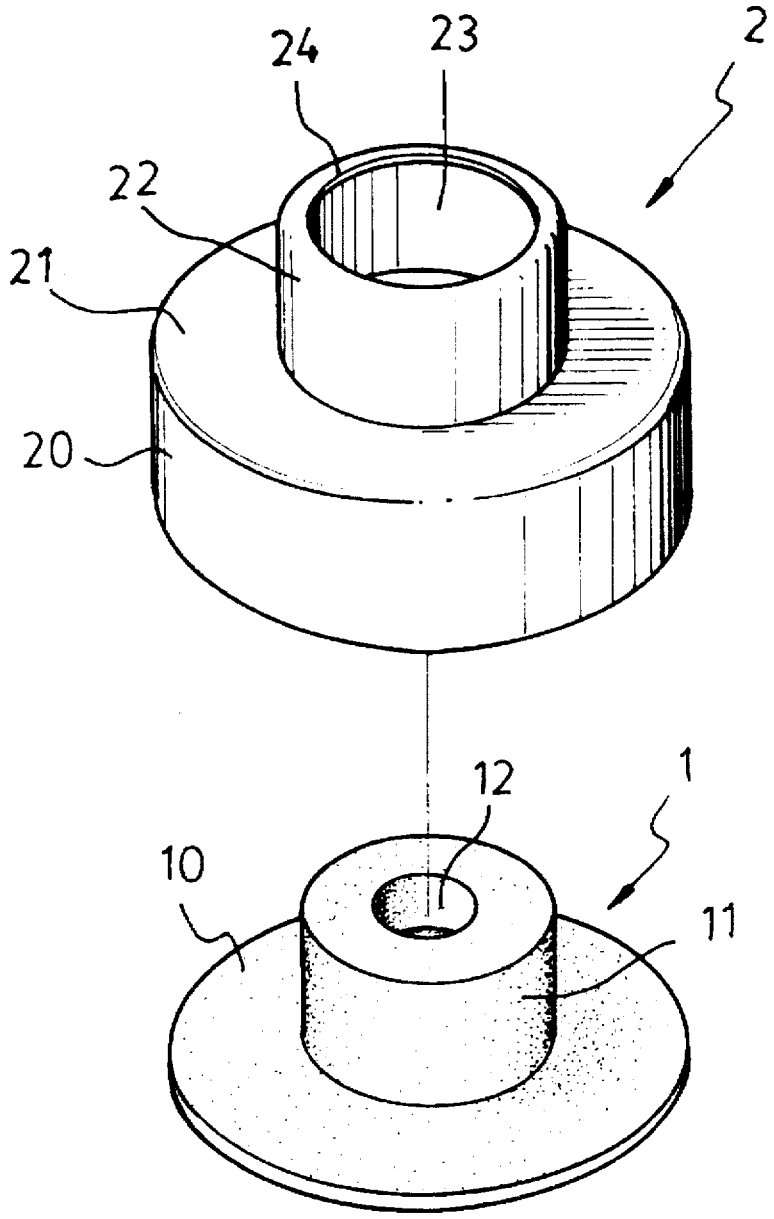
FIG. 3 is an exploded view of a sealing cap according to the present invention.
Figure 4:
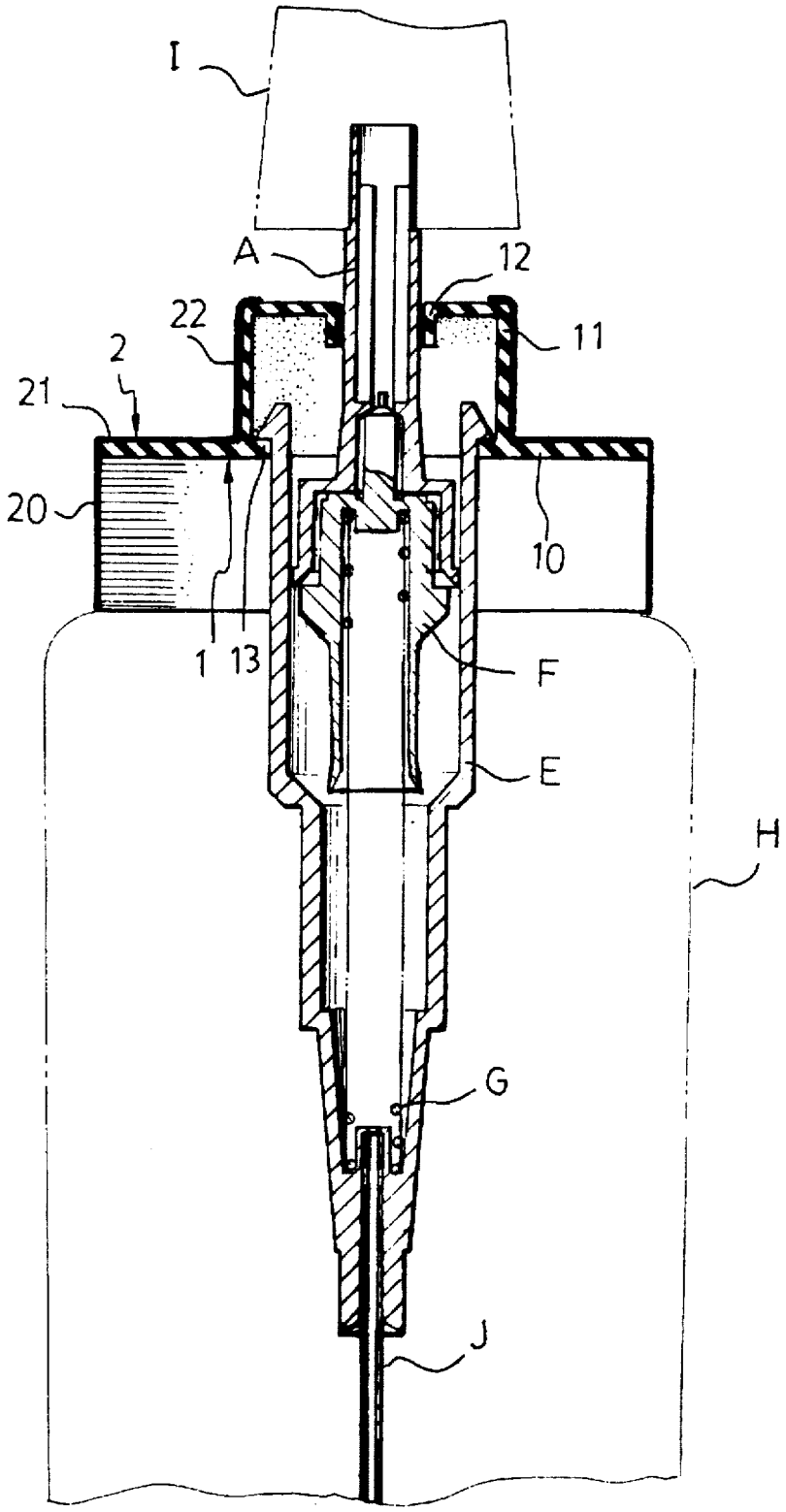
FIG. 4 is a sectional view showing the sealing cap installed in the atomizer.

Referring to FIGS. 3 and 4, the sealing cap of the present invention is generally comprised of a sealing rubber 1, and a metal cap shell 2 fitting over the sealing rubber 1. The sealing rubber 1 is shaped like a cap comprising a flat annular base 10, a hollow cylindrical head 11 raised from the inner side of the flat annular base 10, an annular coupling portion 13 extending inwardly from the connecting area between the flat annular base 10 and the hollow cylindrical head 11 on the inside, and a downwardly extending annular flange 12 at the top center of the hollow cylindrical head 11. The metal cap shell 2 comprises a flat annular base 21 attached to the top side of the flat annular base 10 of the sealing rubber 1 a cylindrical flange 20 extends downwardly from the border of the flat annular base 21 and encloses around the periphery of the flat annular base 10 of the sealing rubber 1. A cylindrical barrel 22 extends from the inner side of the flat annular base 10 and enclosed around the hollow cylindrical head 11 of the sealing rubber 1. The barrel 22 has an inwardly extending annular top flange 24 defining a center through hole 23 and enclosing the topmost circumferential edge of the hollow cylindrical head 11 of the sealing rubber 1.

Referring to FIG. 4 again, the hooked top end of the cylinder E is hooked on the annular coupling portion 13 of the sealing rubber 1 and suspended inside the container H, the bottom plunger A of the press head 1 is inserted through the downward annular flange 12 of the sealing rubber 1 and coupled to the piston F, which is movably disposed inside the cylinder E and supported on a compression spring G above a dip tube J, which is connected to the cylinder E at the bottom for inducing liquid from the container H into the cylinder E. The outer diameter of the hollow cylindrical head 11 is slightly smaller than the inner diameter of the barrel 22 of the metal cap shell 2. Therefore the downward annular flange 12 is compressed against the periphery of the bottom plunger A to seal the gap when the hollow cylindrical head 11 of the sealing rubber 1 is fitted into the center through hole 23 of the barrel 22 of the metal cap shell 2.

I claim:

1. A sealing cap comprising a metal cap shell and a sealing rubber fitted into said metal cap shell for mounting around the bottom plunger of a press head of an atomizer, said metal cap shell comprising a flat annular base having an inner periphery and an outer periphery, a cylindrical flange extending downwardly from the outer periphery of the flat annular base of said metal cap shell, a cylindrical barrel extending upwardly from the inner periphery of the flat annular base of said metal cap shell and having an inwardly extending top annular flange defining a top opening of the barrel, said sealing rubber comprising a flat annular base fitted within the downwardly extending cylindrical flange of said metal cap shell and attached to the interior side of the flat annular base of said metal cap shell, a hollow cylindrical head extending upwardly from the flat annular base of said sealing rubber and defining a connecting area therewith the cylindrical head being fitted within the barrel of said metal cover shell, an annular coupling portion extending inwardly from the connecting area of the flat annular base and hollow cylindrical head of said sealing rubber, and a downwardly extending annular flange at the center of the topmost edge of said hollow cylindrical head for tightly engaging the periphery of the bottom plunger of the press head of the atomizer.

* * * * *